US006495950B1

(12) United States Patent
Ito et al.

(10) Patent No.: US 6,495,950 B1
(45) Date of Patent: Dec. 17, 2002

(54) DEFLECTION YOKE FOR COLOR CATHODE-RAY TUBE

(75) Inventors: Katsumi Ito, Fukushima (JP); Akihiko Mori, Fukushima (JP); Kazuhiko Endo, Fukushima (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/533,363

(22) Filed: Mar. 22, 2000

(51) Int. Cl.[7] ..... H01J 29/70
(52) U.S. Cl. ..... 313/440; 313/412; 313/431
(58) Field of Search ..... 313/440, 412, 313/413, 431, 437; 335/210, 212

(56) References Cited

U.S. PATENT DOCUMENTS 5,770,932 A * 6/1998 Nakane ..... 313/412

* cited by examiner

*Primary Examiner*—Vip Patel
*Assistant Examiner*—Ken A Berck
(74) *Attorney, Agent, or Firm*—Ronald P. Kananen PLLC; Rader, Fishman & Grauer PLLC

(57) ABSTRACT

A deflection yoke capable of easily adjusting a member having a pair of magnetic pieces by moving the member to a standard state in the case of correcting misconvergence. According to the deflection yoke of the invention, a member having a pair of magnetic pieces disposed in the horizontal deflection direction is attached to an electron gun side of the deflection yoke. The shape of a part of each of ends of the member coincides with a part of the outer shape of the electron gun side of the deflection yoke. The adjusting person can easily set the member into the standard state by adjusting the parts with his/her fingers. By moving the member in the horizontal direction from such a state, misconvergence can be corrected.

2 Claims, 10 Drawing Sheets

DEFLECTION YOKE FOR COLOR CATHODE-RAY TUBE

BACKGROUND OF THE INVENTION

1. Field of the Invention

The present invention relates to a deflection yoke for a color cathode-ray tube and a display using a deflection yoke.

2. Description of the Relative Art

FIG. 1 shows an example of a deflection yoke for use in a computer display.

A deflection yoke 11 comprises a cathode ray tube 1, horizontal deflection coil 2, a vertical deflection coil 3, a magnetic core 4, and other parts.

When a current is passed through the horizontal deflection coil 2, a horizontal deflection magnetic field is generated.

Three electron beams of a color cathode-ray tube 1 are scanned in the horizontal direction by the horizontal deflecting magnetic field.

When a current is passed through the vertical deflection coil 3, a vertical deflection magnetic field is generated and electron beams are scanned in the vertical direction.

A coil 5 is attached to a back cover 10 of the deflection yoke 11.

The back cover 10 is provided with a mechanism for attaching a member 6 having a magnetic substance.

Both the coil 5 and the member 6 are used to correct what is called misconvergence.

The coil 5 corrects the misconvergence by actively generating a magnetic field by the passage of a current from the outside to the coil 5.

On the other hand, the member 6 corrects the misconvergence by passively changing the horizontal deflection magnetic field.

The horizontal deflection magnetic field generated by the horizontal deflection coil 2 is changed by an influence of the magnetic substance attached to the member 6.

The degree of the change in the magnetic field varies according to the position of the magnetic substance of the member 6.

By the change in the horizontal deflection magnetic field, a slight change occurs in the tracks of the electron beams.

The convergence characteristic of the cathode-ray tube accordingly changes.

By adjusting the fitting position of the member 6, therefore, the convergence can be adjusted.

The back cover 10 is attached to the neck portion side of the deflection yoke 11, that is, to the electron gun side of the cathode-ray tube.

As shown in FIG. 2, conventionally, the members 6 each having a magnetic piece 7 are attached independently to the right and left sides of the back cover 10.

Whether or not the member 6 has to be used is determined at the time of manufacture of a computer display.

That is, when the member 6 is unnecessary for the correction of the misconvergence, the member 6 is not used.

On the other hand, when it is determined to be necessary, the member 6 is attached to either the right or left side of the back cover 10.

In the case of manufacturing computer displays of the same kind, a computer display having no member 6 and that having the member 6 mixedly exist.

Between them, due to the existence/absence of the member 6, there is a subtle difference in the convergence characteristic of the whole screen.

In recent years, as the resolution of the computer display becomes higher, the subtle variation in the convergence characteristic has been becoming unignorable.

In order to solve the problem, a method of disposing a member integrally having magnetic pieces on its both sides and simultaneously moving both of the right and left magnetic pieces, thereby correcting misconvergence, has been proposed.

In such a manner, the magnetic pieces are always used.

In an actual use, however, it is necessary to perform positioning, that is, to position both of the magnetic pieces to be symmetrical with respect to the electron gun as a center since this state corresponds to a standard state when the convergence is adjusted.

When the member is move d in the lateral direction from the standard state, the convergence changes according to the movement amount.

The visual positioning has, however, a drawback with respect to the efficiency of the work and reliability.

SUMMARY OF THE INVENTION

It is an object of the invention to provide a deflection yoke capable of simply and certainly positioning a member to which a pair of magnetic substances are attached as well as easily correcting misconvergence, and to provide a display having no variations in the convergence characteristic caused by the presence/absence of the member.

A deflection yoke according to the invention comprises a horizontal deflection coil, a vertical deflection coil, and a core.

A member for correcting misconvergence is attached to the neck part of the deflection yoke, that is, on the electron gun side.

The member has an opening, and a pair of magnetic pieces are attached to the member symmetrically with respect to the opening as a center.

The member is attached to the neck side of the deflection yoke so as to be mechanically movable in the horizontal deflection direction of an electron beam.

In such a state, the pair of magnetic pieces are arranged in the horizontal deflection direction.

The shape of each of the right and left ends of the member coincides with the outer shape of the rear part of the deflection yoke to which the member is attached.

According to the structure, by only moving the member so that the part coincides with the rear part of the deflection yoke, the member is set in the so-called standard state position.

To be specific, the pair of magnetic pieces of the member are set in the symmetrical positions with respect to the axis of the deflection yoke.

By moving the member in the lateral direction from the above state, an influence is exerted on a horizontal deflection magnetic field generated by the horizontal deflection coil.

After the deflection yoke is attached to the cathode-ray tube, the neck portion of the cathode-ray tube is inserted through the opening in the member.

When the member is moved in the lateral direction, the pair o magnetic pieces become asymmetrical and the horizontal deflection magnetic field of the neck portion changes.

Thus, by adjusting the movement amount in the lateral direction of the member, convergence can be adjusted.

Since the member is moved only in the lateral direction and always exists, the pair of magnetic pieces are always used.

In a display using the deflection yoke according to the invention, therefore, no subtle variation occurs in the convergence, the variation conventionally caused by the presence/absence of the magnetic pieces.

Thus, variations in the convergence characteristic are reduced in the manufacture of the same kind of displays.

DETAILED DESCRIPTION OF THE PREFERRED EMBODIMENT

An embodiment of the invention will be described hereinbelow.

Figure 1:
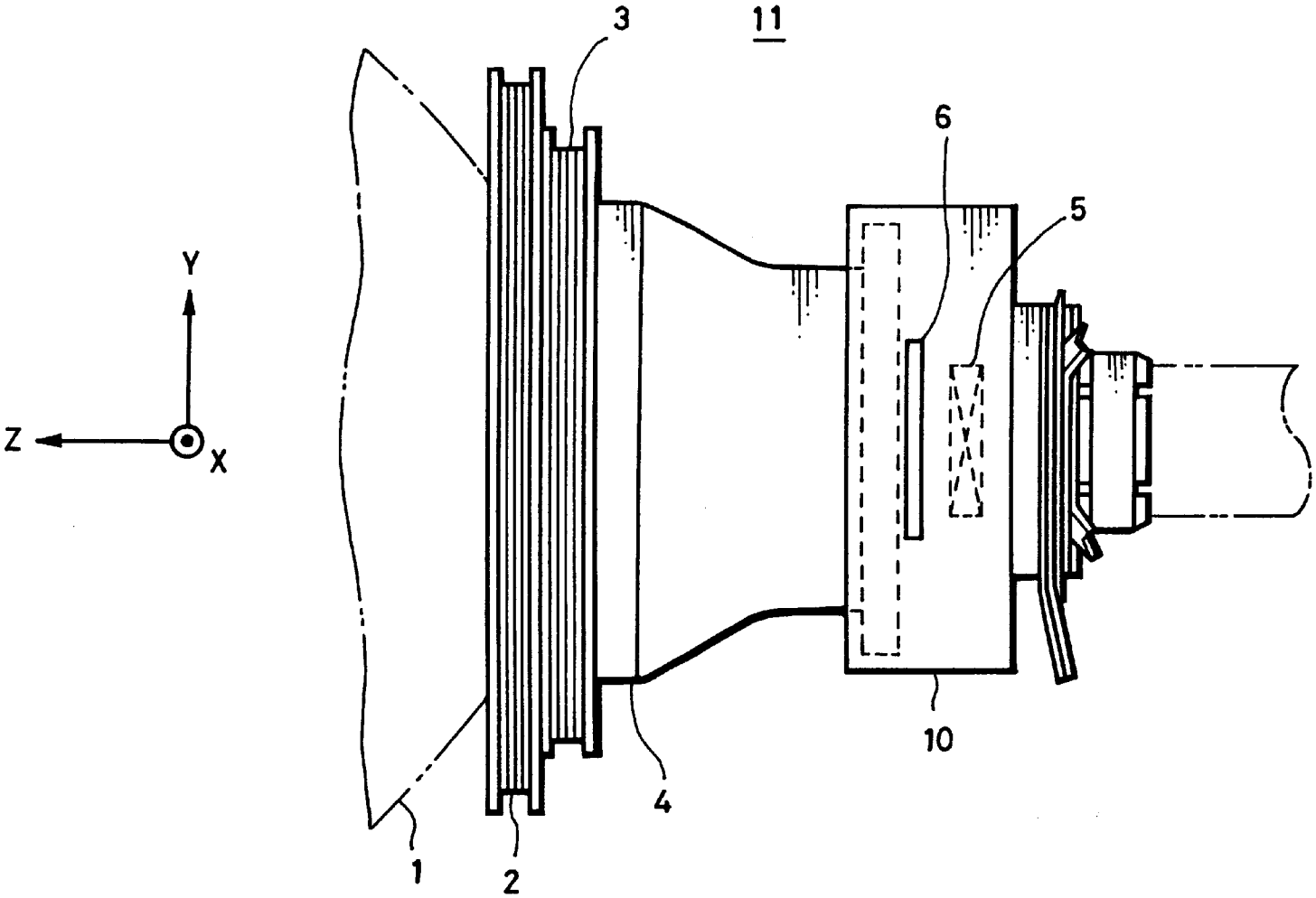
FIG. 1 is a diagram showing the configuration of a deflection yoke according to a conventional technique.
Figure 2:
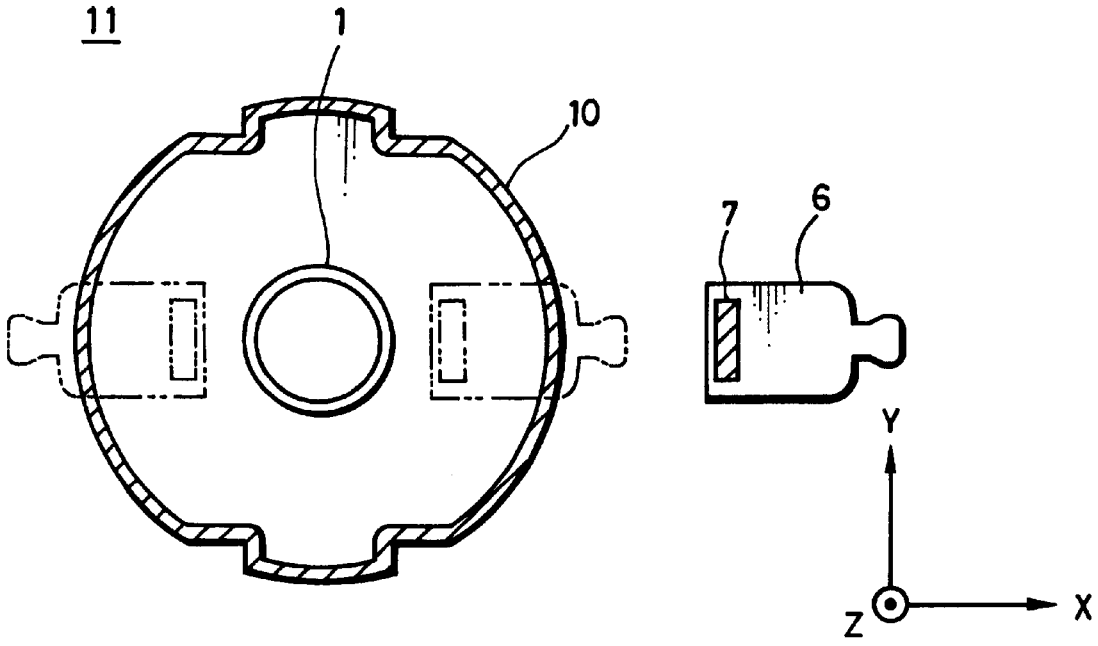
FIG. 2 is a diagram for explaining a case of inserting a member for correcting misconvergence into the conventional deflection yoke.
Figure 3:
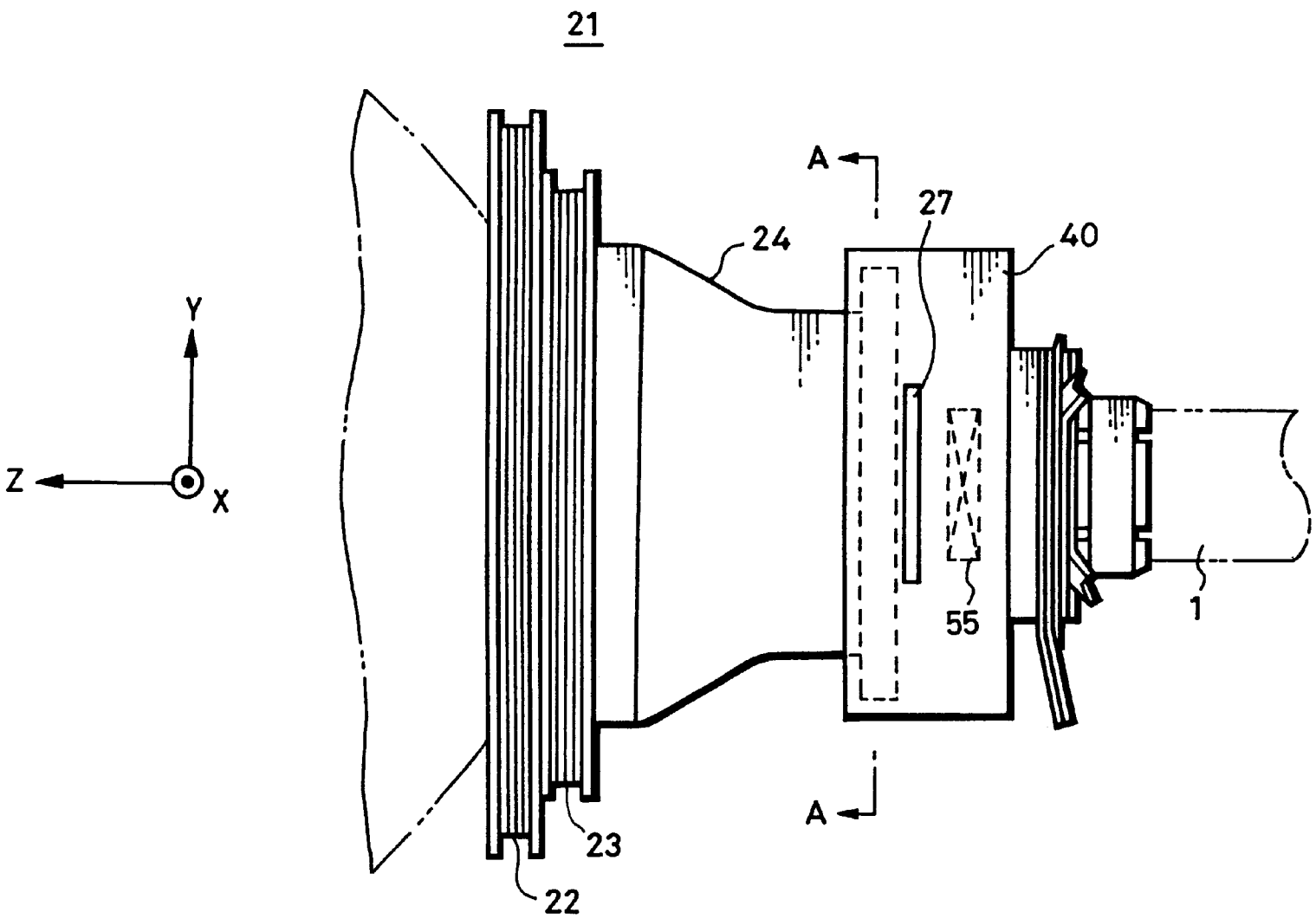
FIG. 3 is a diagram showing the configuration of a deflection yoke according to the invention.

FIG. 3 shows the configuration of a deflection yoke for a cathode-ray tube according to the invention.

A deflection yoke 21 has a separator 22 of a shape covering the funnel part of the cathode-ray tube 1, which is molded of plastic or the like.

A horizontal deflection coil 23 is disposed inside the separator 22. A vertical deflection coil 24 is disposed on the outside of the separator 22. An annular core 25 is disposed so as to cover the vertical coil 24.

Further, a member 27 having a pair of magnetic pieces is attached to the rear end part of the deflection yoke on the neck portion side.

Figure 4:
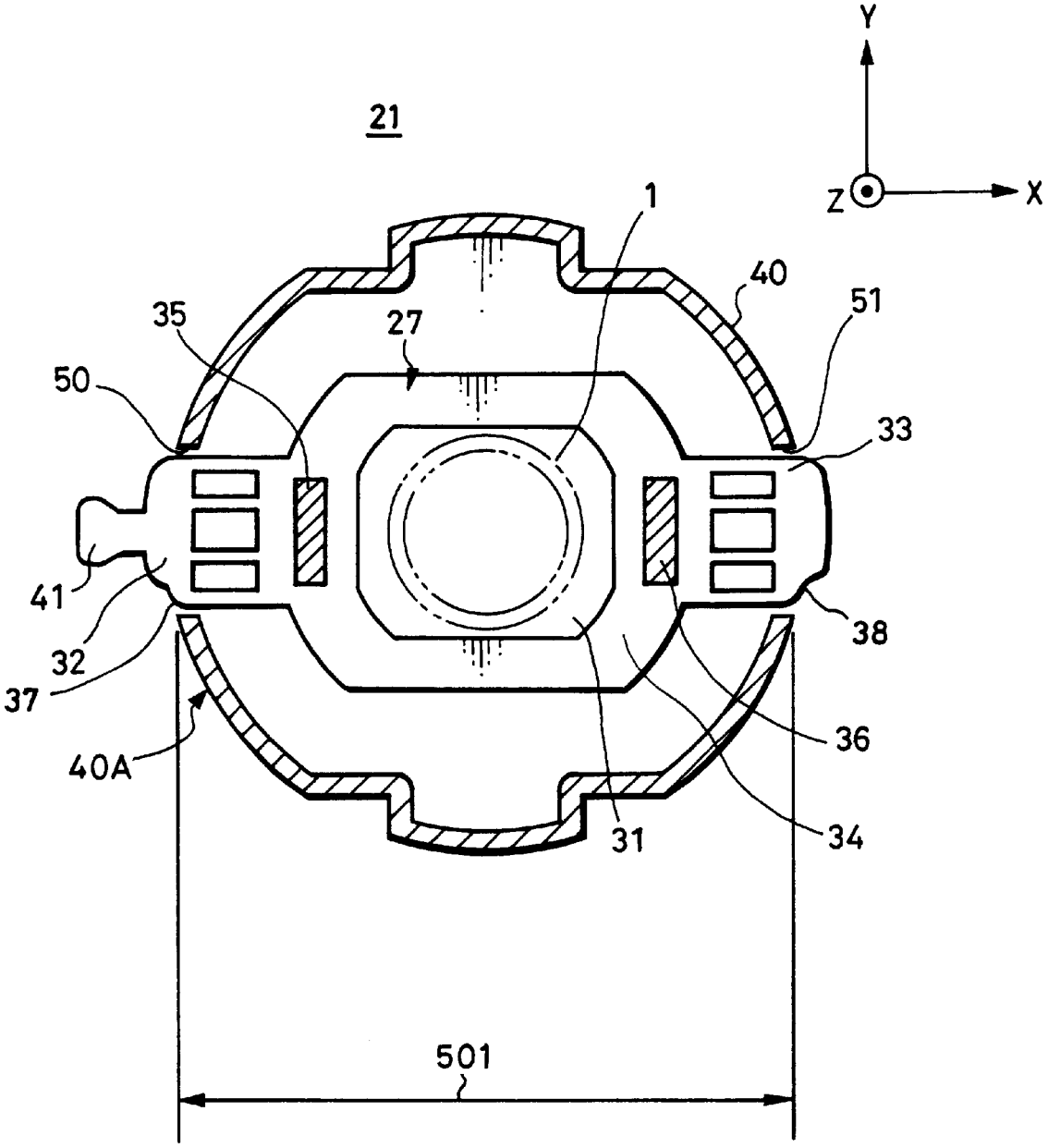
FIG. 4 is a cross section taken along line A—A of FIG. 3.

As shown in FIG. 4, the member 27 comprises a plate 34 and magnetic pieces 35 and 36. The plate 34 is made of an insulating material such as plastic and the like and has an opening 31 through which the neck part of the cathode-ray tube 1 is passed. The magnetic pieces 35 and 36 are attached in positions symmetrical with respect to the opening 31 as a center.

In the member 27, an end 32 has a positioning part 37 and an end 33 has a positioning part 38. Each of the positioning parts 37 and 38 has the same shape as the body for holding the member 27, that is, the back cover 40.

Figure 5A:
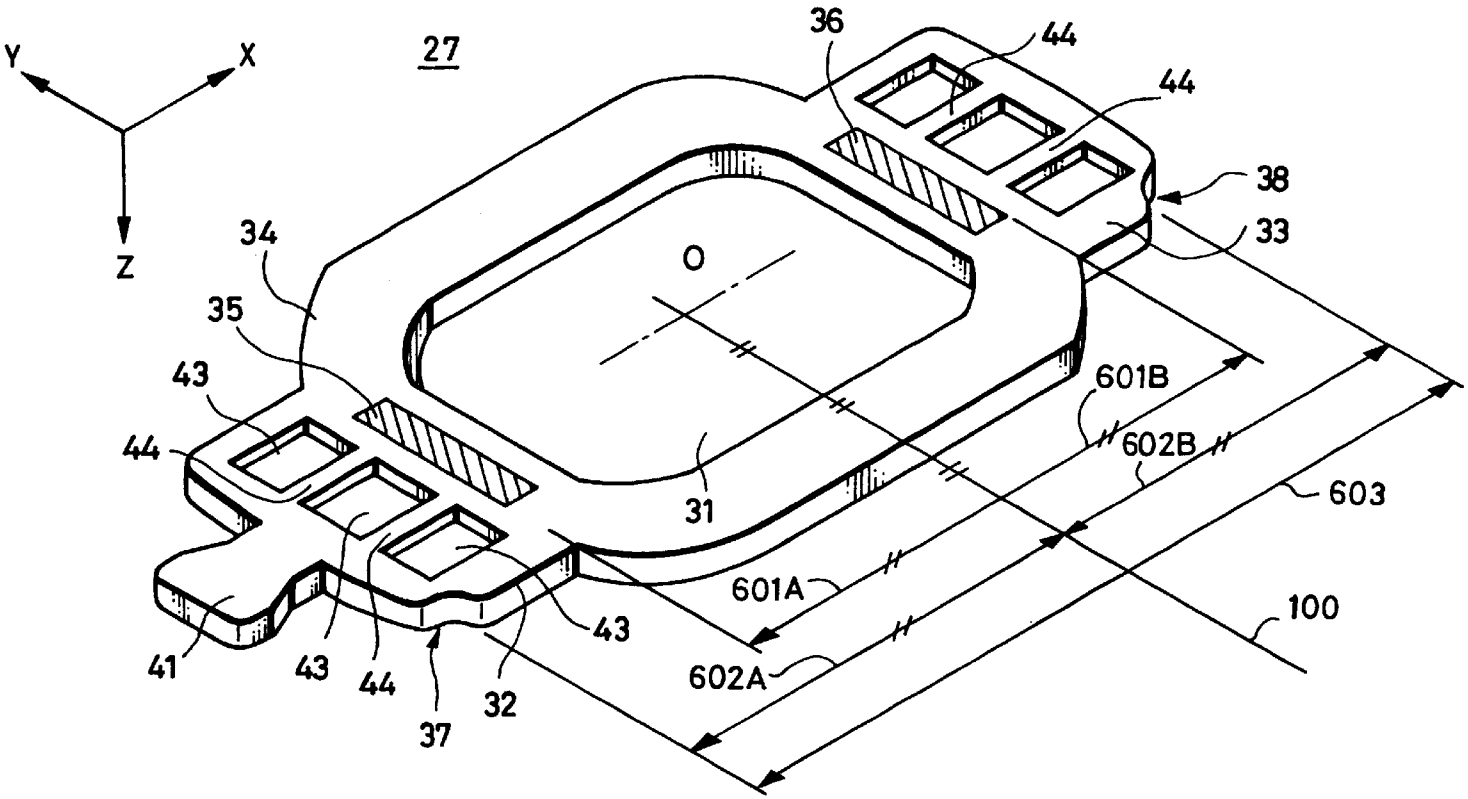
FIGS. 5A and 5B are a perspective view and a cross section, respectively, of the member for correcting misconvergence used in the invention.

As shown in FIG. 5A, a distance 601A between the center line of the opening 31 and the magnetic piece 35 and a distance 601B between the center line 100 and the magnetic piece 36 are set to be equal to each other.

A distance 602A between the center line 100 and the positioning part 37 in the end 32 and a distance 602B between the center line and the positioning part 38 in the end 33 are also set to be equal to each other.

A distance 603 between the positioning parts 37 and 38 formed in the ends 32 and 33 is set to be equal to a distance 501 between the right and left outer sides of the back cover 40 shown in FIG. 4.

Figure 5B:
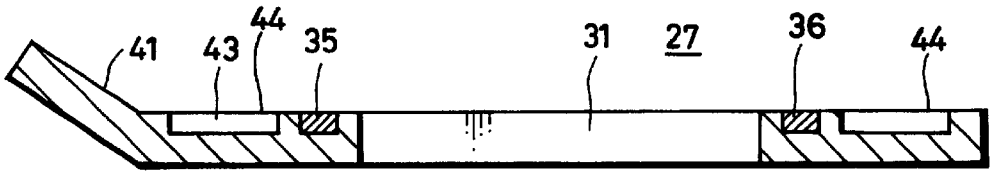

As shown in FIGS. 5A and 5B, the magnetic pieces 35 and 36 are disposed in recesses formed in the insulating plate 34 so as to be flush with the surface of the insulating plate 34.

A knob 41 is integrally formed in one of the ends, 32, of the insulating plate 34.

In each of the ends 32 and 33, two ribs 44 are formed by the creation of recesses 43 in the horizontal deflection direction, that is, along the X axis on the face in which the magnetic pieces 35 and 36 are disposed.

Figure 6:
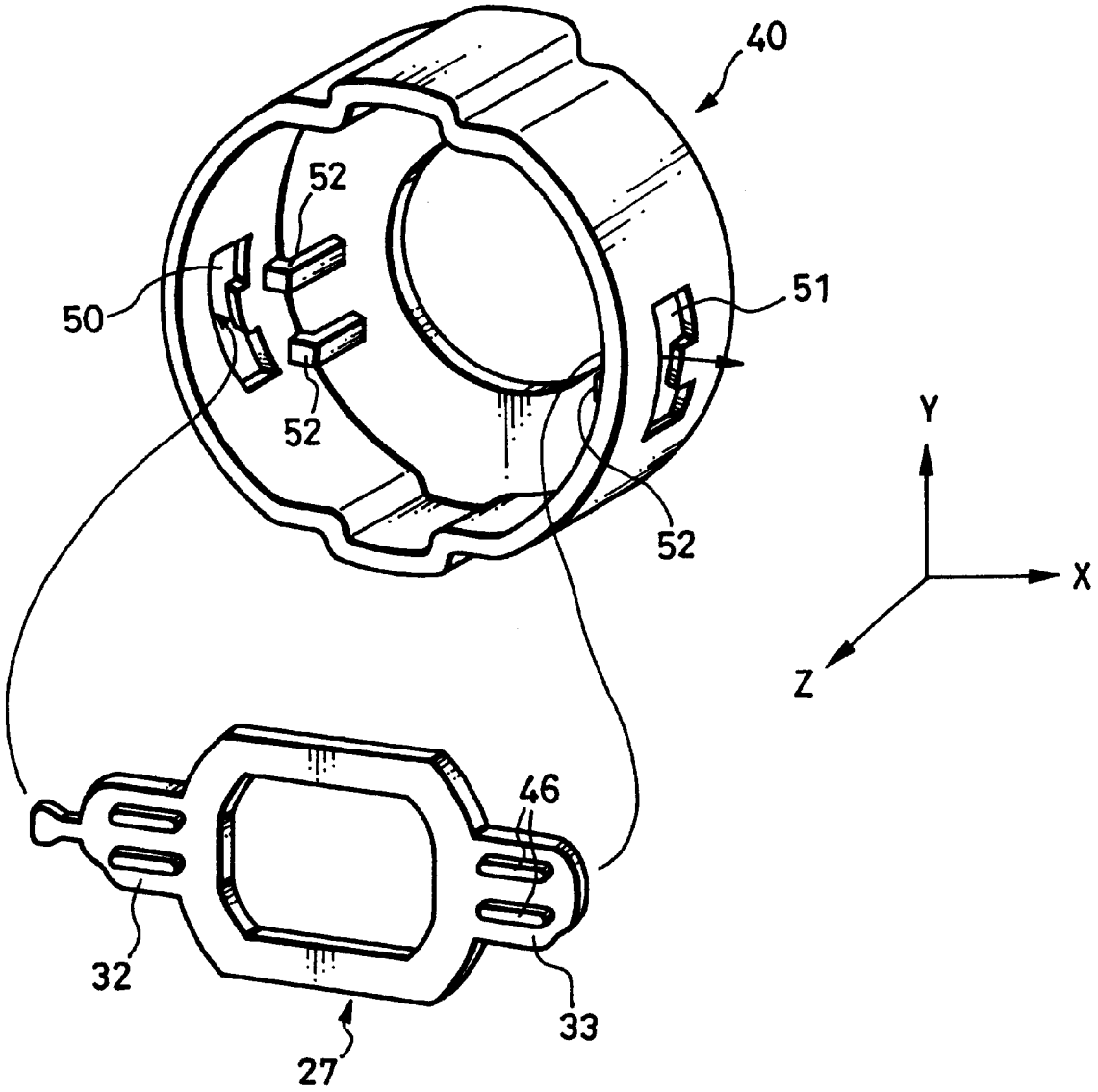
FIG. 6 is a perspective view of the member for correcting misconvergence used in the invention and a back cover for holding the member.

On the other face, as shown in FIG. 6, a pair of projections 46 which are in parallel along the X axis are formed.

The member 27 is attached to the back cover 40 which is fit to the rear part of the deflection yoke, so as to be adjustably movable in the X axis direction.

Specifically, as shown in FIG. 6, apertures 50 and 51 through which the ends 32 and 33 of the member 27 are inserted are opened on the right and left sides of the back cover 40.

By inserting the extended parts 32 and 33 into the insertion apertures 50 and 51, the member 27 is movably held by the back cover 40.

The member 27 is attached in such a manner that one of the ends 32 of the member 27 is inserted to one of the apertures 50, and the other end 33 is inserted into the other aperture 51 while bending the member 27.

Figure 8:
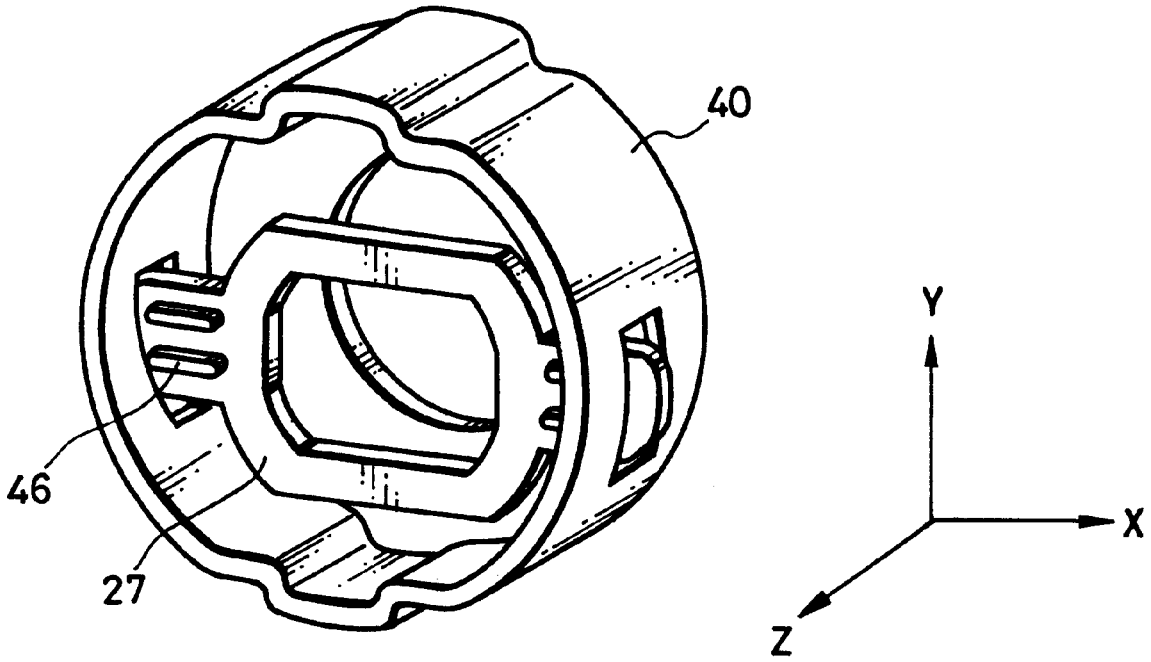
FIG. 8 is a perspective view showing a state where the member for correcting misconvergence used for the invention is held by the back cover.

FIG. 8 shows a state where the member 27 is attached to the back cover 40.

Figure 9:
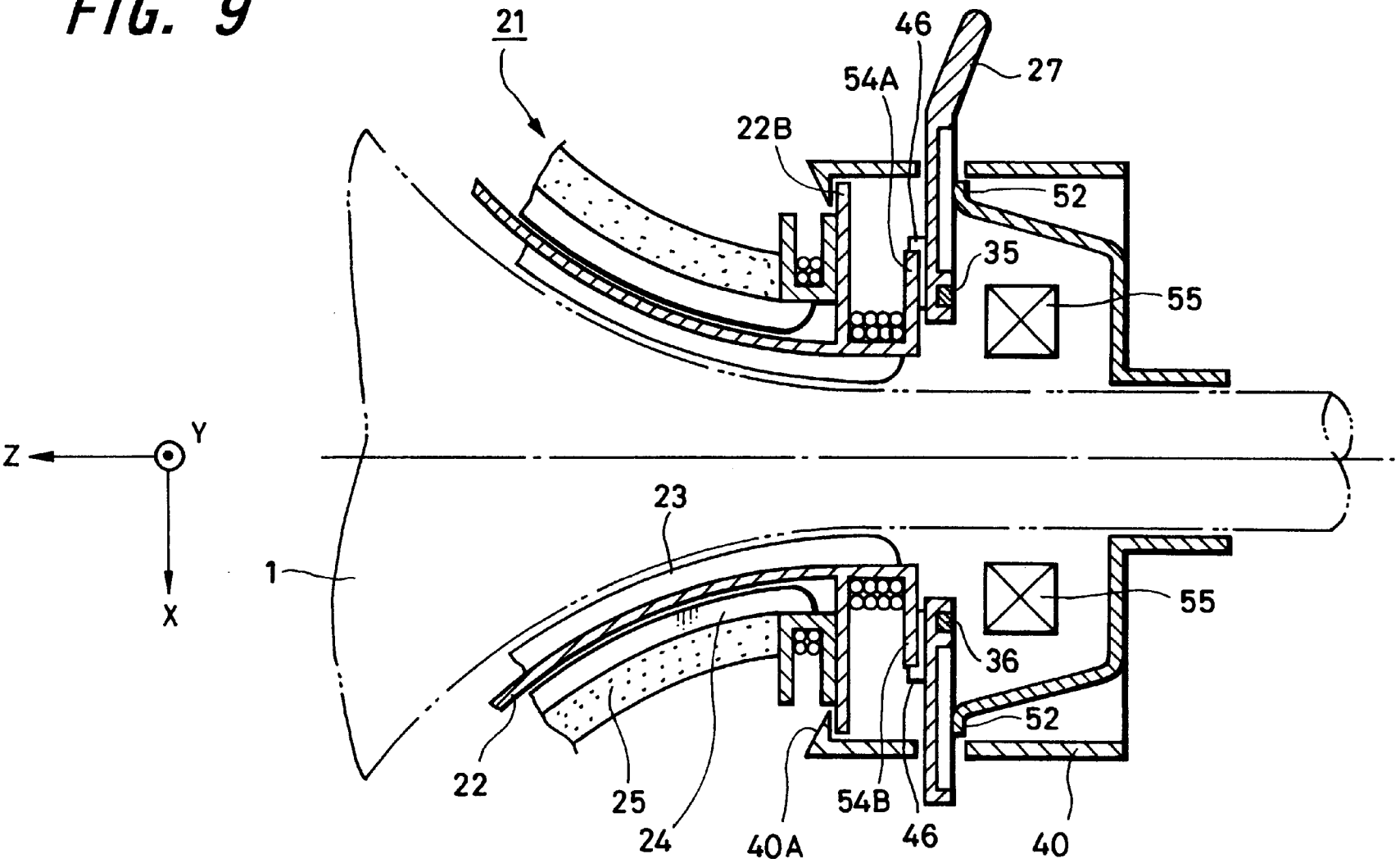
FIG. 9 is a cross section showing the structure of the main part of the deflection yoke according to the invention.

As shown in FIGS. 6 and 9, four butt parts 52 integrally formed in the back cover 40 come into contact with the four ribs 44 on the member 27 side.

Figure 10:
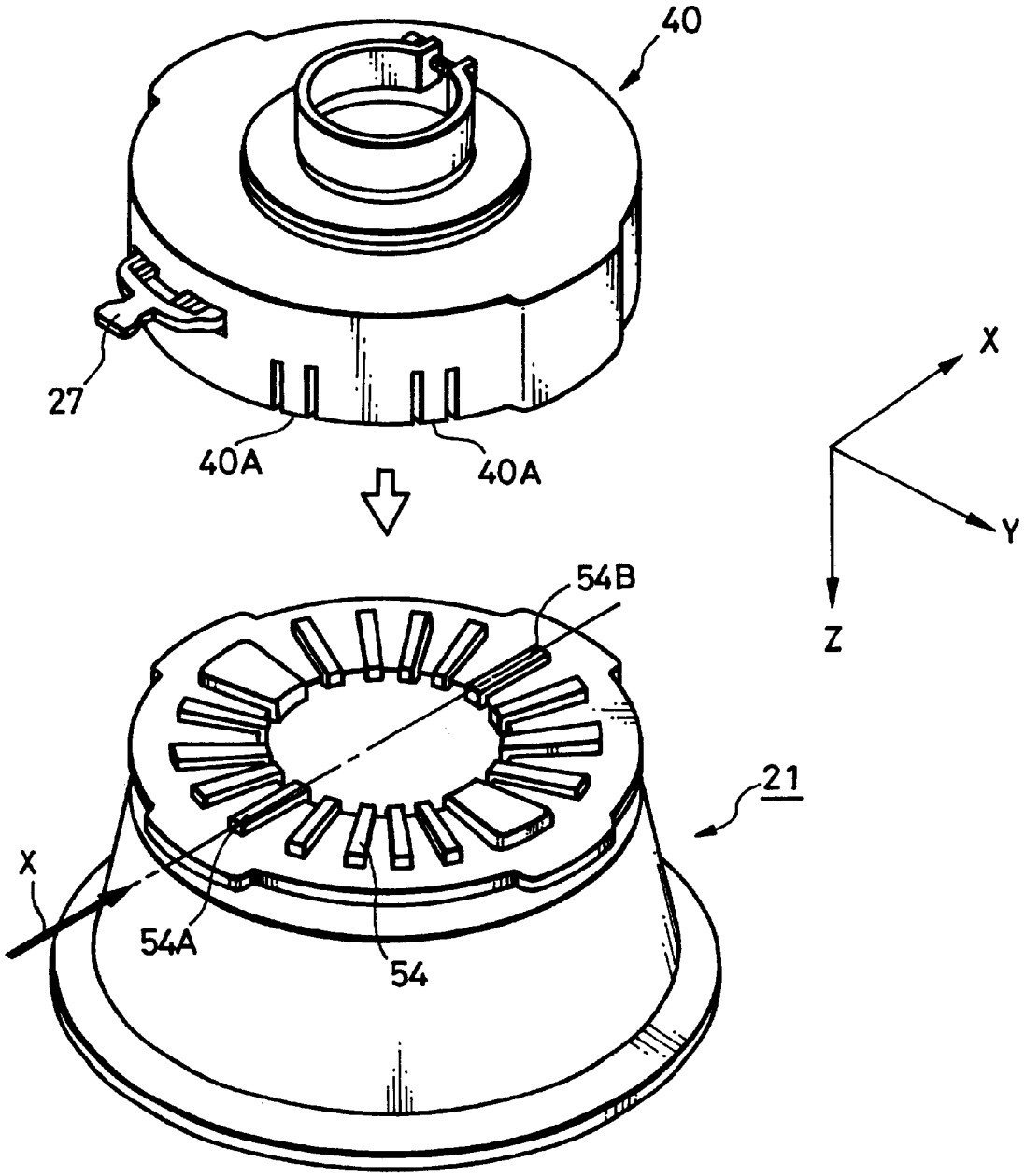
FIG. 10 is an exploded perspective view showing a method of attaching the back cover used for the invention.

As illustrated in FIG. 10, the back cover 40 is attached to the rear part of the deflection yoke 21.

Specifically, as shown in FIG. 9, a nail 40A of the back cover 40 engages with a rear flange 22B of the separator 22.

In the state, as shown in FIGS. 6 and 10, each of nails 54A and 54B on the X axis among a plurality of nails 54 for winding the deflection coil engages with a groove formed between the pair of projections 46 of the member 27. That is, the X axis of the member 27 and the X axis of the deflection yoke coincide with each other. Simultaneously, the member 27 is made movable so as to be guided by the nails 54A and 54B.

With such a configuration, the member 27 is made in a standard state when the pair of magnetic pieces 35 and 36 of the member 27 are in the left and right symmetrical positions with respect to the electron gun on the horizontal deflection axis.

Figure 7:
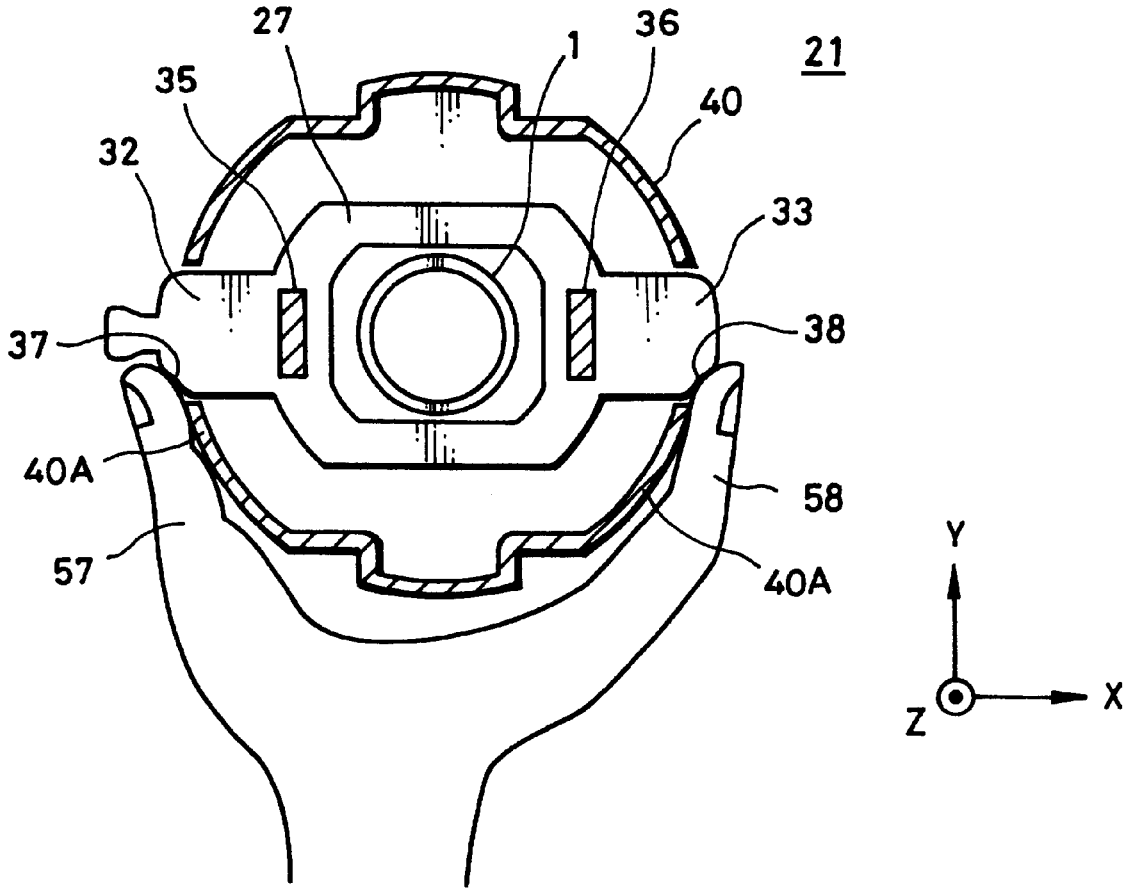
FIG. 7 is a diagram for explaining a case of setting the member for correcting misconvergence into a standard mode in the deflection yoke according to the invention.

As shown in FIG. 7, in order to position the member 27 so as to be in the standard state, it is sufficient for the adjusting person to pinch the back cover 40 by fingers 57 and 58 so that the tips of the fingers 57 and 58 are on the positioning parts 37 and 38.

That is, the adjusting person moves the member 27 so that the faces of the positioning parts 37 and 38 coincide with the faces 40A of the both outer sides of the back cover 40 each other.

Since the adjusting person can check whether the faces coincide with each other or not by the touch, the adjustment can be extremely easily performed.

By obtaining this state, the center O of the opening 31 of the member 27 coincides with the centers of the electron gun and the tube axis.

That is, the magnetic pieces 35 and 36 are held so as to be symmetrical with respect to the electronic gun, that is, in the standard state.

When misconvergence remains in the screen of the cathode-ray tube after obtaining the standard state, adjustment is performed by moving the member 27 either to the right or left side.

The member is moved so as to make the convergence preferable. While maintaining the state, an adhesive or the like is applied to the areas of the holes 50 and 51 of the back cover 40 to fix the member 27 to the back cover 40.

According to the invention, the pair of magnetic pieces of the member can be easily set to the symmetrical positions with respect to the axis of the deflection yoke.

By adjusting the movement amount in the lateral direction of the member from the state, convergence can be adjusted.

Since the member is always used, variations in the convergence characteristic are reduced in the manufacture of the same kind of displays.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A deflection yoke having a neck portion for a color cathode-ray tube, comprising a member having a horizontal axis for correcting misconvergence, wherein a pair of magnetic pieces are attached symmetrically on the horizontal axis of the member, the member is attached to the neck portion of the deflection yoke so as to be movable in the horizontal axis direction, and a part of the shape of each of the right and left ends of the member coincides with the shape of the neck portion of the deflection yoke.

2. A display comprising a color cathode-ray tube and a deflection yoke, wherein the deflection yoke has a member having a horizontal axis and right and left ends for correcting misconvergence, a pair of magnetic pieces are attached symmetrically on the horizontal axis of the member, the member is attached to the neck portion of the deflection yoke so as to be movable in the horizontal axis direction, and a part of the shape of each of the right and left ends of the member coincides with the shape of a part of the neck portion of the deflection yoke.

* * * * *